US009925451B2

(12) United States Patent
Ramthansiama

(10) Patent No.: US 9,925,451 B2
(45) Date of Patent: Mar. 27, 2018

(54) APPARATUS FOR PLAYING GAMES

(71) Applicant: Ramthansiama, Aizawl (IN)

(72) Inventor: Ramthansiama, Aizawl (IN)

( * ) Notice: Subject to any disclaimer, the term of this patent is extended or adjusted under 35 U.S.C. 154(b) by 0 days.

(21) Appl. No.: 15/152,807

(22) Filed: May 12, 2016

(65) Prior Publication Data

US 2016/0332057 A1 Nov. 17, 2016

(30) Foreign Application Priority Data

May 12, 2015 (IN) ..... 520/KOL/2015

(51) Int. Cl.
*A63B 67/00* (2006.01)
*A63B 71/02* (2006.01)
*A63C 19/00* (2006.01)

(52) U.S. Cl.
CPC ..... *A63B 71/02* (2013.01); *A63C 19/00* (2013.01); *A63F 2250/21* (2013.01)

(58) Field of Classification Search
CPC ..... A63C 19/00; A63F 2250/21; A63B 71/02
USPC ..... 473/415, 416, 476
See application file for complete search history.

(56) References Cited

U.S. PATENT DOCUMENTS 2,282,128 A * 5/1942 Gubbins ..... A63F 3/00075 273/262
4,389,048 A * 6/1983 Burgess ..... A63F 7/0058 273/108.1
4,563,011 A * 1/1986 Ferris ..... A63F 3/00145 273/243
5,219,316 A * 6/1993 Huffman ..... A63J 11/00 472/62
5,320,358 A * 6/1994 Jones ..... A63B 63/00 273/371
5,868,637 A * 2/1999 Poxon ..... A63B 9/00 473/469
5,906,373 A * 5/1999 Sanders ..... A63B 67/00 273/349
6,213,466 B1 * 4/2001 Rosen ..... A63F 3/00082 273/236
6,248,019 B1 * 6/2001 Mudie ..... A63F 9/0291 463/49
8,172,230 B2 * 5/2012 Killgo ..... A63F 3/00006 273/248

(Continued)

*Primary Examiner* — Vishu Mendiratta
(74) *Attorney, Agent, or Firm* — Blueshift IP, LLC; Robert Plotkin

(57) ABSTRACT

An apparatus for playing games is envisaged. It includes a structure that defines boundary of the apparatus. There are multiple elements placed on the apparatus that define player locations. The apparatus can of any size and shape and can be used by players for playing various games. The players can use movable devices separately or the devices can be associated with players for the purpose of playing different games. Multiple lanes are placed at pre-defined positions on the structure for forming junctions in order to control and guide movement of players or moveable devices or movable devices associated with players. These junctions and lanes together form a number of turns that change direction of movement of players during the game play. The apparatus includes transparent bodies, speed regulators, marking units for marking the players and counters for counts number of markings for the purpose of playing different games.

3 Claims, 4 Drawing Sheets

(56) References Cited

U.S. PATENT DOCUMENTS

| | | | | |
|---|---|---|---|---|
| 8,777,226 | B1 * | 7/2014 | Decker, Jr. | F41J 7/06<br>273/406 |
| 2003/0118971 | A1 * | 6/2003 | Rogachev | F41G 3/26<br>434/11 |
| 2005/0021205 | A1 * | 1/2005 | Niwa | B60G 17/016<br>701/37 |
| 2008/0023913 | A1 * | 1/2008 | Barthold | A63F 3/00<br>273/241 |

* cited by examiner

APPARATUS FOR PLAYING GAMES

FIELD OF DISCLOSURE

The present disclosure relates to the field of entertainment systems with traction structures.

BACKGROUND

Various types of entertainment systems and games are popular now-a-days and played for entertainment in various different contexts. Strategy games like paintball, marking games, and different war gaming systems have been existent since a significant period of time. The existing formats of such games have received little attention from television sports broadcaster due to the fact that these formats are not television friendly. Such games may be fun and entertaining to play but they tend to be difficult and troublesome to watch on electronic devices such as television, computers, and laptops as well as in outdoor environment due to the lack of a singular point of visual focus for the spectators. Most strategy games or marking game systems involve barriers that obstruct the view of player as well as the spectator's. This reduces the entertainment factor of the games for the spectators. During such games, it becomes difficult for the spectators to spot movement, marking or shots made by the players. Additionally, during some strategy games there maybe multiple players engaging simultaneously while hiding behind barriers without much movement and the lack of well-designed, speed regulating and guided traction apparatus during such game plays makes it hard for the viewers to watch and follow the action on the field. Further, the decision making in such games is limited to when to hit, run and save oneself.

Therefore, there is a need for an entertainment system with traction apparatus to limit the aforementioned drawbacks and provide an apparatus that enhances strategic thinking and quick decision making skills.

Objects

An object of the present disclosure is to provide an apparatus for playing games.

Another object of the present disclosure is to provide an apparatus that is spectator friendly and provides a clear and unimpeded view of the actions in organized manner for the spectators.

Still another object of the present disclosure is to provide an apparatus that allows viewers to easily watch and follow the action on the traction apparatus.

Yet another object of the present disclosure is to provide an apparatus that can be used in both indoor and outdoor environment.

An additional object of the present disclosure is to provide a cost-effective apparatus for entertainment as well as for enhancing tactical thinking and quick decision making skills.

One more object of the present disclosure is to provide an apparatus that allows narrowing the focus to at least two players at a time thus making the play and non-field action easier to follow.

Other objects and advantages of the present disclosure will be more apparent from the following description when read in conjunction with the accompanying figures, which are not intended to limit the scope of the present disclosure.

SUMMARY

The present disclosure envisages an apparatus for playing games.

Typically in accordance with the present disclosure the apparatus comprises a structure that defines a boundary of the apparatus. A plurality of pre-determined elements is placed around the structure in order to define locations for players or movable devices or movable devices associated with players to enter the structure. A plurality of lanes are placed at pre-defined positions on the structure which form a plurality of junctions for controlling and guiding movement of players or moveable devices or movable devices associated with players. These lanes further form a plurality of turns for changing direction of movement of players or moveable devices or movable devices associated with players. The structure also includes a plurality of speed regulators attached on the structure for interaction and manipulation with movement and speed of the players or the moveable devices or the movable devices associated with the players. At least one transparent body is erected on the apparatus to provide obstructions and physical interactions to the players or the moveable devices or the movable devices associated with the players. The apparatus also includes a plurality of marking units for marking the players or the moveable devices or the movable devices associated with the players, and at least one counter configured to count number of markings on each player or moveable device or movable device associated with each player.

BRIEF DESCRIPTION OF ACCOMPANYING DRAWING

An apparatus for playing games will now be explained in relation to the non-limiting accompanying drawing, in which:

FIG. 1(*b*) illustrates an isometric view of the apparatus illustrated in FIG. 1(*a*);

DETAILED DESCRIPTION OF THE ACCOMPANYING DRAWING

Figure 1:
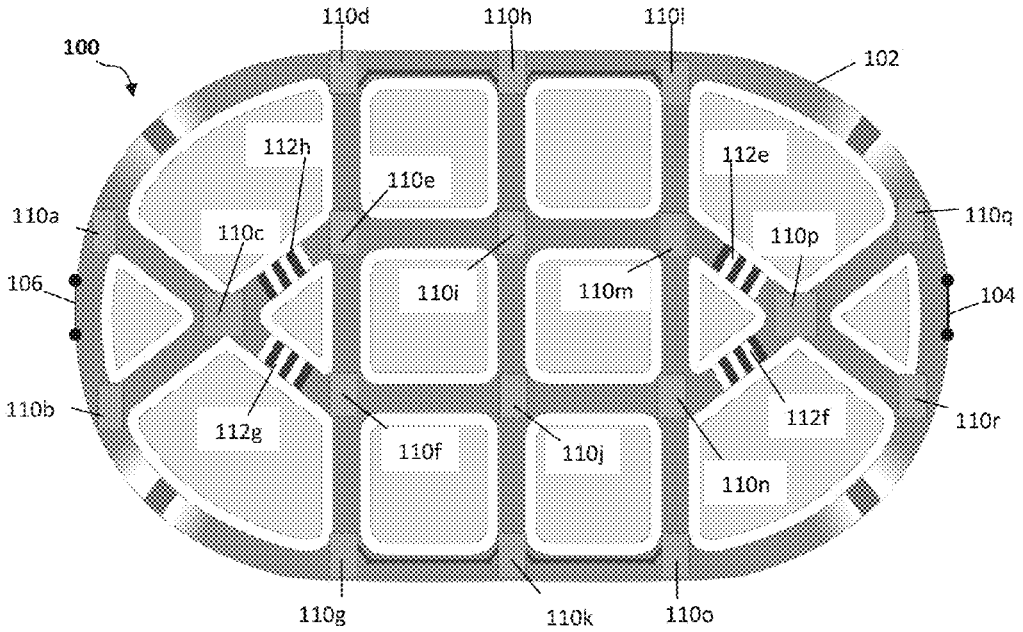
FIG. 1 (*a*) illustrates a top plan view of an embodiment of a traction apparatus.
Figure 1:
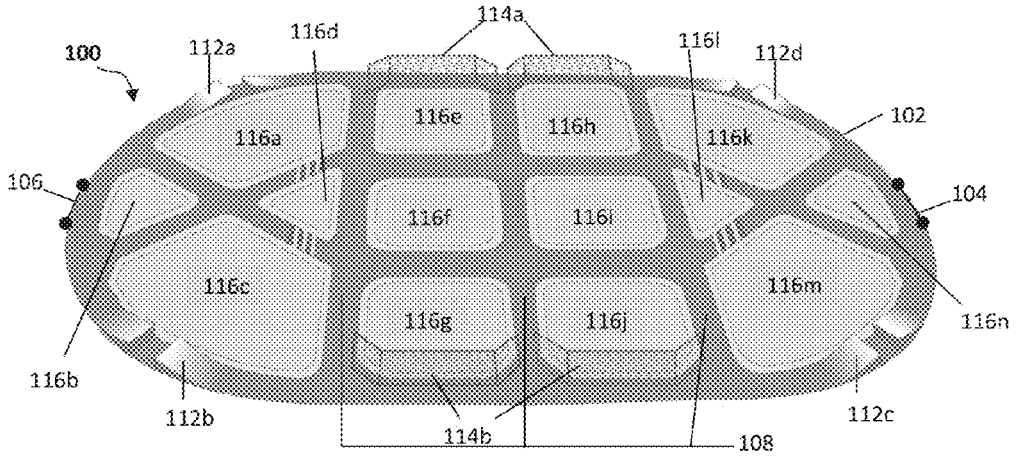

The present disclosure will now be described with reference to the embodiments shown in the accompanying drawing. The embodiments do not limit the scope and ambit of the disclosure. The description relates purely to the examples and preferred embodiments of the disclosed apparatus and its suggested applications.

The apparatus herein and the various features and advantageous details thereof are explained with reference to the non-limiting embodiments in the following description. Descriptions of well-known parameters and processing techniques are omitted so as to not unnecessarily obscure the embodiment herein. The examples used herein are intended merely to facilitate an understanding of ways in which the embodiment herein may be practiced and to further enable those of skill in the art to practice the embodiment herein. Accordingly, the examples should not be construed as limiting the scope of the embodiment herein.

The apparatus as disclosed in the present disclosure is a traction apparatus that includes marking units and optional movable devices for playing various games. The apparatus for playing games as envisaged in the present disclosure comprises a traction unit/structure, which has dedicated lanes forming turns and junctions at strategic positions such that players are forced to make tactical decisions in order to get close to other players. This helps in narrowing the focus to two players at a time. The formed junctions are customizable and can be formed by placing the lanes strategically to obtain three-way junctions, four-way junctions and the like. The three-way junctions provide two optional routes whereas the four-way junctions provide three optional routes when approached by the players from any one route. These junctions are designed to force the players into making decision based on the other player's position and speed by taking one of the optional routes to either escape marking by the opponent or plan marking the other player.

Speed regulators are provided on the traction apparatus to interact with the movement and speed of players or moveable devices or movable devices associated with the players. One or more transparent bodies are also provided to mock physical interactions or obstructions thus adding another tactical dimension to the traction apparatus. The speed regulators and transparent bodies increase the difficulties for players in making successful markings during the game. The players need to get close to their opponents to increase the marking accuracy and consequently the efficacy. To achieve this, the players have to make tactical decisions in order to get close to the other players. This also enables the players to effectively control the speed of their travel in several ways to achieve the desired tactics as well as decide correct route options using junctions, speed regulators and turns.

The envisaged apparatus of the present disclosure is scaled in size to varying degrees to accommodate movable devices. The traction apparatus can be scaled in size of a board game suitable to be played in a room or it can be installed in a large outdoor field. Additionally, the traction apparatus can be a mat, board or physically erected/formed apparatus on the ground. The components/parts of the apparatus such as traction unit/structure, lanes, junctions, turns, transparent bodies, movable devices, speed regulators, marking units and the like are variable and customizable based on the size of the traction apparatus and the user requirement. The movable devices can be optionally used to aid in movement of the players or the players can control them from a distance. The players can ride the movable devices or use the movable devices remotely. These movable devices can be in the form of Go-karts, all forms of skates such as inline skates or skateboards, cycles, or other man-driven or remotely controlled devices/vehicles. The players participating in the game can decide and finalize the movable device to be used, before the game.

Referring to the accompanying drawing, FIG. 1(*a*) and FIG. 1(*b*) respectively illustrate a top plan view and an isometric view of an embodiment of an apparatus 100 for playing games. The apparatus 100 that is used by players, or movable devices or movable devices associated with the players includes a traction unit/structure 102 that defines a boundary of the apparatus 100 for playing games. The shape of this traction unit/structure 102 is customizable. The structure 102 can have a regular or an irregular shape. It can be circular, oval, elliptical, polygonal or any shape that is suitable to the users. In this embodiment, the traction unit/structure 102 is rectangular in shape with rounded corners such as representing two semi-circles, one on each side. The surface of the traction unit/structure 102 is also customizable based on the user preference. This traction unit/structure surface can be made of synthetic materials, natural materials, concrete, asphalt, wood derivatives, bamboo or rubber, fiber-glass, bitumen, dirt, water and similar other materials and/or their combinations. The apparatus 100 includes a plurality of elements 104, 106 placed around the traction unit/structure 102 to define locations for players or movable devices or movable devices associated with the players to enter the traction unit/structure 102. In a preferred embodiment, the structure 102 has two places of entry and two places of exit for the players. This requirement is necessary in a team match although it is not necessary in a singles/individual match. The places for entry and exit should not be close together for safety reasons. The number of elements introduced to allow player entry is variable based on user customization. A plurality of lanes 108 are placed on the traction unit/structure 102 at pre-defined positions to provide a defined track/path/passage for travel, to players or movable devices or movable devices associated with the players. In a preferred embodiment, the plurality of lanes 108 must be placed on the structure 102 such that they form more than four intersections/junctions and/or turns by crossing each other.

The apparatus 100 includes separators 116*a*, 116*b*, 116*c*, 116*d*, 116*e*, 116*f*, 116*g*, 116*h*, 116*i*, 116*j*, 116*k*, 116*l*, 116*m*, 116*n* that are strategically placed on the traction unit/structure 102 such that the combination of the separators 116*a*, 116*b*, 116*c*, 116*d*, 116*e*, 116*f*, 116*g*, 116*h*, 116*i*, 116*j*, 116*k*, 116*l*, 116*m*, 116*n* and the lanes 108 form plurality of junctions 110*a*, 110*b*, 110*c*, 110*d*, 110*e*, 110*f*, 110*g*, 110*h*, 110*i*, 110*j*, 110*k*, 110*l*, 110*m*, 110*n*, 110*o*, 110*p*, 110*q*, 110*r* for controlling and guiding movement of the players or movable devices or movable devices associated with the players. The separators 116*a*, 116*b*, 116*c*, 116*d*, 116*e*, 116*f*, 116*g*, 116*h*, 116*i*, 116*j*, 116*k*, 116*l*, 116*m*, 116*n* are of variable shapes including circular shape, oval shape, elliptical shape and polygonal shape and also having variable sizes. They can have transparent surface with a depth visible from surface. Such a depth is suitable for outdoor use to make players/users more aware and conscious of the surface in addition to maintaining focus on other players, while moving or choosing direction of travel. The quadrant-shaped separators 116*e*, 116*f*, 116*g*, 116*h*, 116*i*, 116*j* provide sharper turns and uniform junctions. In a preferred embodiment, a player has to choose a track/route carefully to gain tactical advantage over the other player during play. If a player or any part of his/her equipment goes out of the track/route or a certain designated boundary lines parallel to the routes then he/she must face a penalty.

In this embodiment, the junctions 110*a*, 110*b*, 110*d*, 110*g*, 110*h*, 110*k*, 110*l*, 110*o*, 110*q*, 110*r* are three-way junctions and the junctions 110*c*, 110*e*, 110*f*, 110*i*, 110*j*, 110*m*, 110*n*, 110*p* are four-way junctions. The plurality of lanes 108 present on the traction unit/structure 102 encompass the straight areas on the apparatus 100 and also form plurality of turns for changing the direction of movement of players or movable devices or movable devices associated with the players. The junctions 110*a*, 110*b*, 110*c*, 110*d*, 110*e*, 110*f*, 110*g*, 110*h*, 110*i*, 110*j*, 110*k*, 110*l*, 110*m*, 110*n*, 110*o*, 110*p*, 110*q*, 110*r* are smaller area in size, and the lanes 108 have a larger area in size. The apparatus 100 offers minimum of forty possible turns that have varying intensity and acuteness of the angle. The apparatus 100 also includes a plurality of speed regulators 112*a*, 112*b*, 112*c*, 112*d*, 112*e*, 112*f*, 112*g*, 112*h* that are attached on the traction unit/structure 102 for interaction and manipulation of movement and speed of the players or movable devices or movable devices associated with the players. The speed regulators 112*a*, 112*b*, 112*c*, 112*d* are speed enhancers and 112*e*, 112*f*, 112*g*, 112*h* are speed reducers. These are made of same material as that of the traction unit/structure 102. The speed reducers 112*e*,

112*f*, 112*g*, 112*h* in this embodiment are miniature speed bumps placed closely to each other and the speed regulators 112*a*, 112*b*, 112*c*, 112*d* are two inclined ramps facing each other with a gap in the middle for players or movable devices or movable devices associated with players to jump over. These ramps may span the full width, preferably half the width of the traction unit/structure. The degree of inclination, height as well as the length of the ramps may or may not be equal on both sides and may vary in alternate embodiments. Another embodiment may also include a flat top for players to roll on. The length of the gap in the middle of ramps or the flat top is customizable. These ramps require the players to increase their speed to climb it or jump over it. Transparent bodies 114*a*, 114*b* are erected on the traction unit/structure 102 to provide obstructions and physical interactions to the players or movable devices or movable devices associated with players. These transparent bodies 114*a*, 114*b* are provided to mock physical interactions or obstructions, and can be made of transparent synthetic material or nets (fabric or otherwise), plastic glass or may be made of combination of plastic glass and synthetic net, where the synthetic net is situated above the plastic glass body. In other embodiments the transparent bodies can be situated as per user preference. The apparatus 100 can have different field and track designs to suit a game. The game can be played with the use of tagging or marking equipment which can be used to score points in the game. The apparatus 100 includes marking units (not shown in figure) for marking/tagging the players or movable devices or movable devices associated with players and, also includes at least one counter (not shown in figure) that counts number of marking on each player or movable device or movable device associated with the player. The counter(s) includes at least one sensor to sense the markings. In an embodiment, the marking units include marking or tagging devices such as paintball, airsoft, laser, augmented reality and the like. The marking units are carried by players in their hands or they can be place on the movable devices. The game can also be played without the use of the marking units as a scoring method. Instead, the scoring system can be based on a player successfully trapping and chasing his/her opponent within the confines of the structure 102. The game can be played as a single's match which entails a player versus another player, or it can also be played as a team match, which entails teams versus teams.

In one embodiment a marking unit of rubber or plastic bullets is provided, where when the bullet hits a vest worn by a player, a sound is produced and captured by the sensor present in the counter for counting number of markings on each player or movable device. This is achieved automatically by sensing sounds produced during successful hit by the player. In another embodiment the sensor is a microphone that is either mounted on vest or carried by the player or placed on the movable device. The captured sound is then transmitted to a computer terminal (that acts as a counter) with a user identifier tag, where the total number of sounds or hit sounds after a certain duration or start and end of game is automatically calculated for each player, and displayed on a screen.

In another embodiment of the present disclosure, the elongated side portions of the traction unit/structure can be of variable lengths such that one side portion provides relatively tight turns that other side portion thus forcing the players to reduce their speed significantly in order to make that turn without going off the traction unit/structure. The acuteness of these turns in the traction unit/structure differs, and this presents the players with tactical options as it affects their speed in a significant manner.

In yet another embodiment of the present disclosure, the surface of the traction unit/structure is such that it holds water so that the game is played with any compatible movable devices or movable devices controlled directly or indirectly by players. Such compatible movable devices include boats, ships or watercrafts like jet skis which can be controlled by the players either manually or remotely. Further, in one embodiment, the traction unit/structure is laid on the surface of a water body. Where, the water body is a lake, surface of the lake is the surface of the traction unit/structure.

In an additional embodiment of the present disclosure, the movable devices are flying machines controlled manually or remotely by the players. These flying machines fly within the track/lanes and have the same horizontal limitations as that of a land based movable vehicle or watercraft/boat or the players. Therefore, the flying machines also adhere to the design of the traction unit/structure and the provided lanes within. But, the flying machines have more freedom to maneuver vertically.

The apparatus 100 can be used by the players to play a plurality of games having a plurality of pre-determined rules. These pre-determined rules include rules for minimum speed limit, marking and tagging, starting procedure, player's corner, U-turn and reverse, chasing, trapping, scoring, restarting after the chase, substitution during a team match, penalties and the like.

The minimum speed limit rule forbids the players and their equipment to go below a certain speed during the game. The players must be aware of this rule before they enter the playing field because going below the minimum speed limit entails an immediate penalty. The minimum speed limit can vary because of the different abilities and characteristics of the equipment or vehicles used to play the game. The players may be allowed to mark or tag their opponents with their marking/tagging equipment from anywhere and almost anytime they want. The only exception to this rule can be when a player has completed a chase but has not restarted by going through his/her respective corner. In case of the rule related to the starting procedure, the players can start from outside the structure 102 or playing field, with both (outside) starting positions equal in length from the track entry. The players must not be below the minimum speed limit when they enter the structure 102. The players can be considered to be in the track if the tip of their vehicle, any equipment or any part of their body crosses the line of entry. In case of a team match there must be a separate exit for the player being replaced. Each player must have a designated player's corner. The designated corners should preferably be in the opposite sides or corners of the playing field as far away from each other as possible. A player's corner should be an entire sector, preferably a smaller sector but it is not mandatory. These corners must be used as restarting point after a chase has finished and the player must go through these corners to restart.

In a preferred embodiment, a U-turn/reverse is not allowed anywhere within the structure 102. This means that the player must not be allowed to turn and go back the same way from where the player had approached. Players must utilize different route options provided by the junctions to maneuver and play the game. If a player turns back in the middle of any sector and goes in the opposite direction from where he/she had approached, it can be considered as a violation and respective penalties can be applicable.

In an embodiment, trapping is a tactical maneuver by a player that leaves the opponent in a position where his/her only option is to take the route that inevitably leads to a chase within a relatively short time. This means that the player doing the trapping will chase a trapped player so that he/she can mark/tag the opponent and score points in the process. The trapping rule forbids a player from entering the lane/straight sector 108 whilst their opponent is in it. If a player enters whilst his/her opponent is in the lane 108, the player can face sector penalty. This means that players must regulate their speed accordingly without going below the speed limit and use the nature of the tracks (junctions and lanes) within the playing field to gain a tactical advantage. But if both players enter any junction together then the first player to enter the junction must choose a route and go first. This means that the second player has a tactical advantage as he/she has effectively trapped the other player, forcing a chase. The act of trapping one's opponent in itself, without tagging or marking the other opponent, can also mean scoring predetermined points based on the variation of the game.

In case of the chasing rule, the chase happens after a player has trapped the other player and is trying to get close in order to have a better chance of successfully marking or tagging the player. The duration of the chase may vary but it should be no more than 20 seconds. The length of the chase may also be measured in meters or any other kind of measurement. The players score points by marking or tagging a specific area, i.e. target, on their opponents' equipment or their body. One hit on the target can give one point to the player doing the marking/tagging. The marking/tagging equipment may be allowed to move in all directions in order to aim. The range of movement may vary. The target must be stationary and fixed stably on the player's body, vehicle or equipment. The size, shape and position of the target can vary. The player/team with the most points at the end of the game wins. The players can also score points without marking or tagging if the variation of the game has no marking or tagging allowed. Trapping and chasing the opponents may score points. But trapping alone must not mean scoring points; a player must successfully chase the other player to score. The duration of the chase and what qualifies as a successful chase also varies. The player/team with the most chases or points wins at the end of the game.

Once the chase has ended both the players must go through their corner sections respectively in order to restart the game. The players must go into the corner section and any part of their equipment or body must exit the corner section in order for the player to be allowed to use their marking/tagging equipment. During the aforementioned procedures as well as after the restart, the clock must not be stopped and must run normally as they are considered to be part of how the game is played, i.e. the gameplay. In an embodiment, the players are not allowed to mark or tag their opponents before going through their respective corners and they must always obey the minimum speed limit rules even before restarting the game. Disobeying these rules entails penalty. The players can take as long time as they want to reach and go through their corners. A player can be substituted in the middle of a game round. In one embodiment, a single player should not play continuously for more than five minutes and should at least, play for two minutes at a time. When a player is substituted the outgoing player must only leave through the exit. When the outgoing player has reached a designated line near the exit, only then can the incoming player (substitute) enter the playing field. In case of rules related to penalties, there may be several kinds of penalties in the game depending upon the nature of the foul and infraction. Points can be deducted as a penalty, or an advantage can be removed from a player advantage by making him/her start from a specific location. A player can also be awarded a tactical advantage because of the other player. Point deduction may also be combined with other penalties if the infraction is severe. Suspension and disqualification may also be employed to certain infractions.

These rules can be varied based on the shape of the apparatus 100 and/or player preferences. One or more of the rules can be modified and agreed upon by a majority vote (or unanimous vote) of all players prior to the commencement of the game. It should be understood that these rules applicable to the apparatus 100 are non-limiting and are identical to the rules which apply to the apparatus for playing games as envisaged by the present disclosure including apparatus illustrated in FIG. 2, FIG. 3 and FIG. 4.

Figure 2:
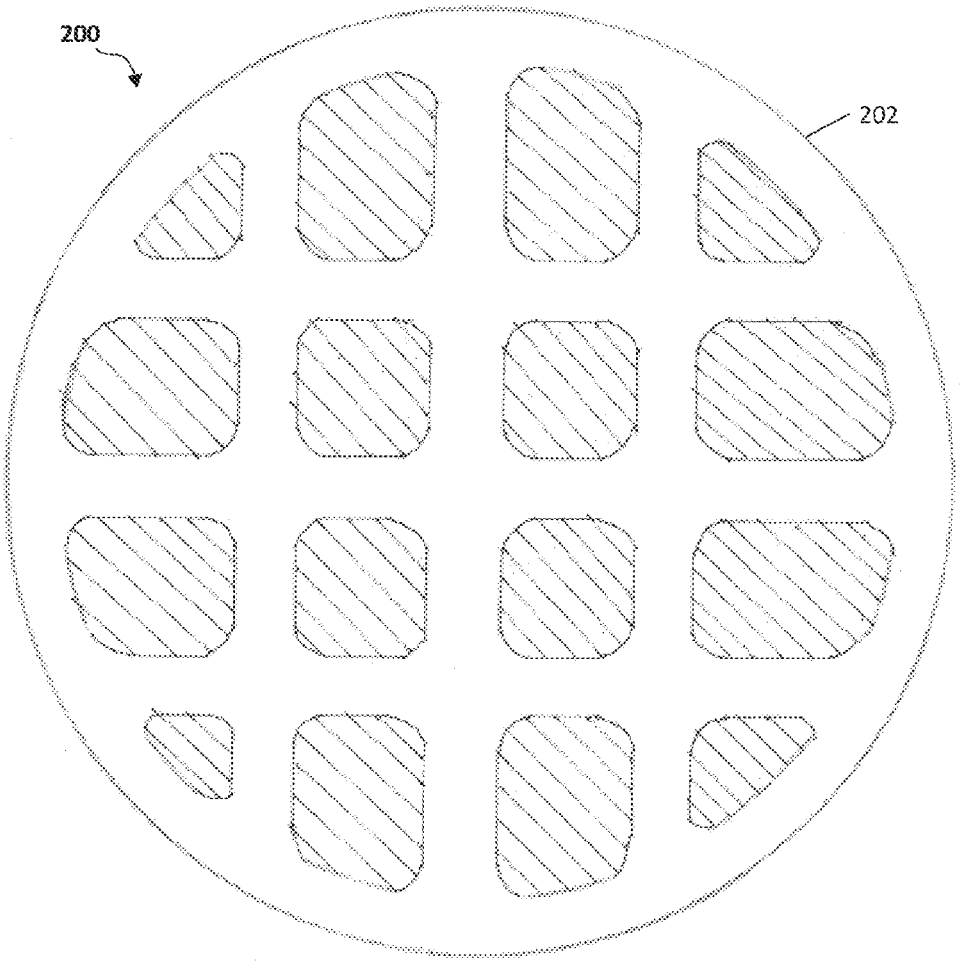
FIG. 2 illustrates another embodiment of a traction apparatus which is suitable for indoor use.

Referring to the accompanying drawing, FIG. 2 illustrates another embodiment of a traction apparatus 200 which is suitable for indoor use. This apparatus 200 is circular in shape and include structure 202 that defines the circular boundary of the apparatus 200. The structure 202 includes plurality of lanes and separators that form multiple junctions. The size of this apparatus 200 is made so as to suit an indoor environment.

Figure 3:
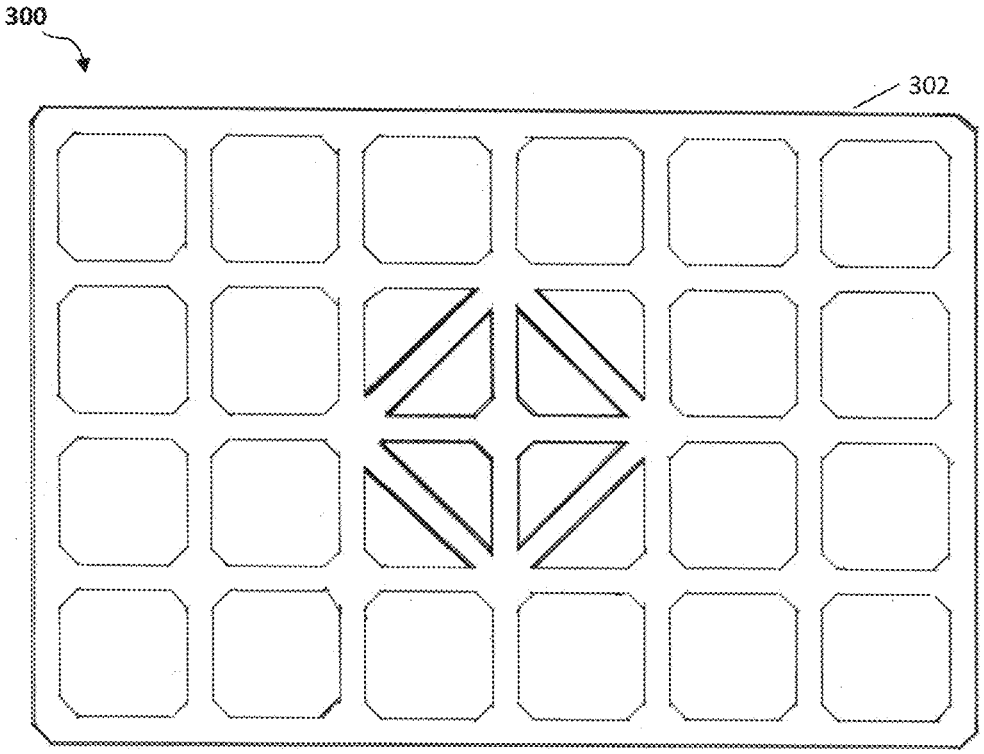
FIG. 3 illustrates an alternative embodiment of a traction apparatus.

Referring to the accompanying drawing, FIG. 3 illustrates an alternative embodiment of a traction apparatus 300 which can be made to suit indoor as well as outdoor environment. The traction apparatus 300 in this embodiment is of a rectangular shape that includes a structure 302 for defining a rectangular boundary of the apparatus 300. It includes multiple lanes and separates of different shapes that form multiple junctions. The size of this apparatus 300 is customizable as per user requirement.

Figure 4:
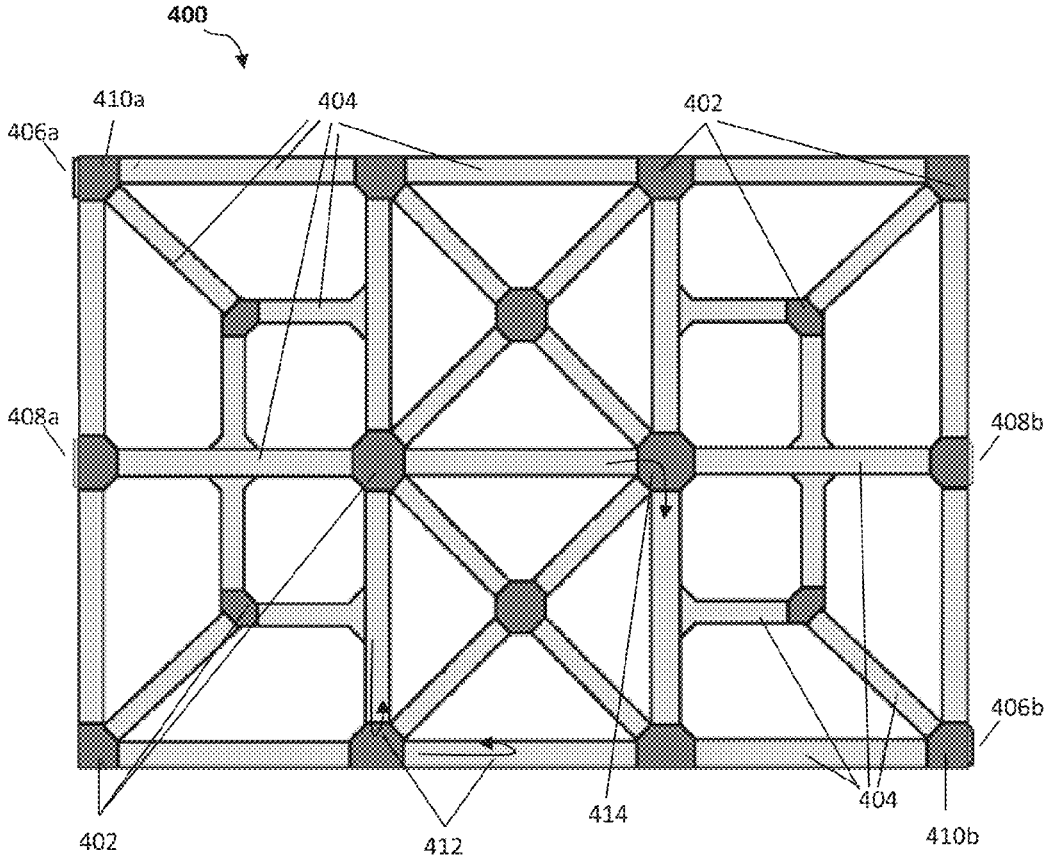
FIG. 4 illustrates another alternative embodiment of a traction apparatus.

Referring to the accompanying drawing, FIG. 4 illustrates another alternative embodiment of a traction apparatus 400 which can be made to suit indoor as well as outdoor environment.

This apparatus 400 is rectangular in shape and includes a plurality of junctions 402 and a plurality of lanes 404. The apparatus 400 also includes two places of entry 406*a* and 406*b*, and two places of exit 408*a* and 408*b* for the players. This requirement is necessary in a team match although it is not necessary in a singles/individual match. Each player has a designated player's corner 410*a* and 410*b*. The designated player's corners 410*a* and 410*b* are in the opposite sides or corners of the playing field as far away from each other as possible. A U-turn/reverse as illustrated by 412 is not allowed anywhere within the structure of the apparatus 400. This means that a player must not take a U-turn/reverse and go back the same way from where the player had approached. Additionally, all players must utilize different route options provided by the junctions to maneuver and play the game, such as a right turn as illustrated by 414. These rules can be varied based on the shape of the apparatus 400 and/or player preferences.

Technical Advancements

An apparatus for playing games in accordance with the present disclosure described herein above has several technical advancements including but not limited to the realization of:

- an apparatus that is spectator friendly and provides a clear and unimpeded view of the actions in organized manner for the spectators;
- an apparatus that allows viewers to easily watch and follow the action on the traction apparatus;

an apparatus that can be used in both indoor and outdoor environment;

a cost-effective apparatus for entertainment as well as for enhancing tactical thinking and quick decision making skills; and an apparatus that allows narrowing the focus to at least two players at a time thus making the play and non-field action easier to follow.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. An apparatus for playing games, comprising:

a structure defining a boundary of said apparatus;

a plurality of pre-determined elements placed around said structure to define locations for players or moveable devices or movable devices associated with players to enter the structure;

a plurality of lanes placed at pre-defined positions on the structure to provide a defined track for travel, to players or moveable devices or movable devices associated with players, said plurality of lanes forming a plurality of junctions for controlling and guiding movement of players or moveable devices or movable devices associated with players, and further forming a plurality of turns for changing direction of movement of players or moveable devices or movable devices associated with players;

a plurality of speed regulators attached on the structure for interaction and manipulation with movement and speed of the players or the moveable devices or the movable devices associated with the players, wherein said plurality of speed regulators includes at least one speed enhancer formed by two inclined ramps facing each other with a gap in the middle and, at least one speed reducer formed by at least one speed bump;

at least one transparent body erected on the structure to provide obstructions and physical interactions to the players or the moveable devices or the movable devices associated with the players;

a plurality of marking units for marking the players or the moveable devices or the movable devices associated with the players, wherein a sound is produced when the plurality of marking units hits the players or the moveable devices or the movable devices associated with the players; and at least one counter configured to count number of markings on each player or moveable device or movable device associated with each player, wherein said at least one counter includes at least one sensor to sense markings made by said plurality of marking units, wherein said sensor senses markings by capturing said sound.

2. The apparatus as claimed in claim 1, wherein shape of said structure is selected from a group consisting of circular, oval, elliptical, polygonal and any combinations thereof.

3. The apparatus as claimed in claim 1, wherein said apparatus includes a plurality of separators placed strategically in combination with said plurality of lanes to form said plurality of junctions and said plurality of turns, shape of said plurality of separators selected from a group consisting of circular, oval, elliptical, polygonal and any combination thereof.

* * * * *